US008104143B2

(12) United States Patent
Heger et al.

(10) Patent No.: US 8,104,143 B2
(45) Date of Patent: Jan. 31, 2012

(54) BUILT-IN DOMESTIC APPLIANCE WITH HINGE COVER

(75) Inventors: Bernd Heger, Haunsheim (DE); Karl-Friedrich Laible, Langenau (DE); Roland Vetter, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 106 days.

(21) Appl. No.: 11/794,209

(22) PCT Filed: Nov. 30, 2005

(86) PCT No.: PCT/EP2005/056339

§ 371 (c)(1),
(2), (4) Date: Feb. 15, 2008

(87) PCT Pub. No.: WO2006/069880

PCT Pub. Date: Jul. 6, 2006

(65) Prior Publication Data

US 2008/0189909 A1 Aug. 14, 2008

(30) Foreign Application Priority Data

Dec. 23, 2004 (DE) ..... 10 2004 062 238

(51) Int. Cl.
*E05D 11/10* (2006.01)

(52) U.S. Cl. ..... 16/347; 16/404; 16/223; 16/250; 16/251; 312/326

(58) Field of Classification Search ..... 16/347, 16/223, 225, 250, 251, 286, 404; 49/461, 49/462, 460; 312/296, 326, 327, 325
See application file for complete search history.

(56) References Cited

U.S. PATENT DOCUMENTS 853,507 A 5/1907 Fielding
1,358,519 A * 11/1920 Carter ..... 16/72
2,557,716 A * 6/1951 Allee ..... 16/250

(Continued)

FOREIGN PATENT DOCUMENTS

DE 44 18 238 11/1995

(Continued)

OTHER PUBLICATIONS

International Search Report PCT/EP2005/056339.

*Primary Examiner* — Victor Batson
*Assistant Examiner* — Emily Morgan
(74) *Attorney, Agent, or Firm* — James E. Howard; Andre Pallapies

(57) ABSTRACT

A built-in domestic appliance which comprises hinges for hinging a door to the furniture body of the built-in domestic appliance. The door is used to close an opening of the first furniture body. The hinges are adapted to perform a defined opening and closing movement of the door, a gap forming during this movement between the edge of the door and especially the front of a second furniture body adjoining the furniture body. In order to obviate the risk of injury caused for example by limbs being caught in the gap and any claims for damages resulting therefrom, a plate element in the area of the door and in a transitional area between the furniture body of the built-in domestic appliance and the second furniture body is mounted in such a manner that it covers the gap if possible across its entire length.

25 Claims, 3 Drawing Sheets

U.S. PATENT DOCUMENTS

Figure 2:
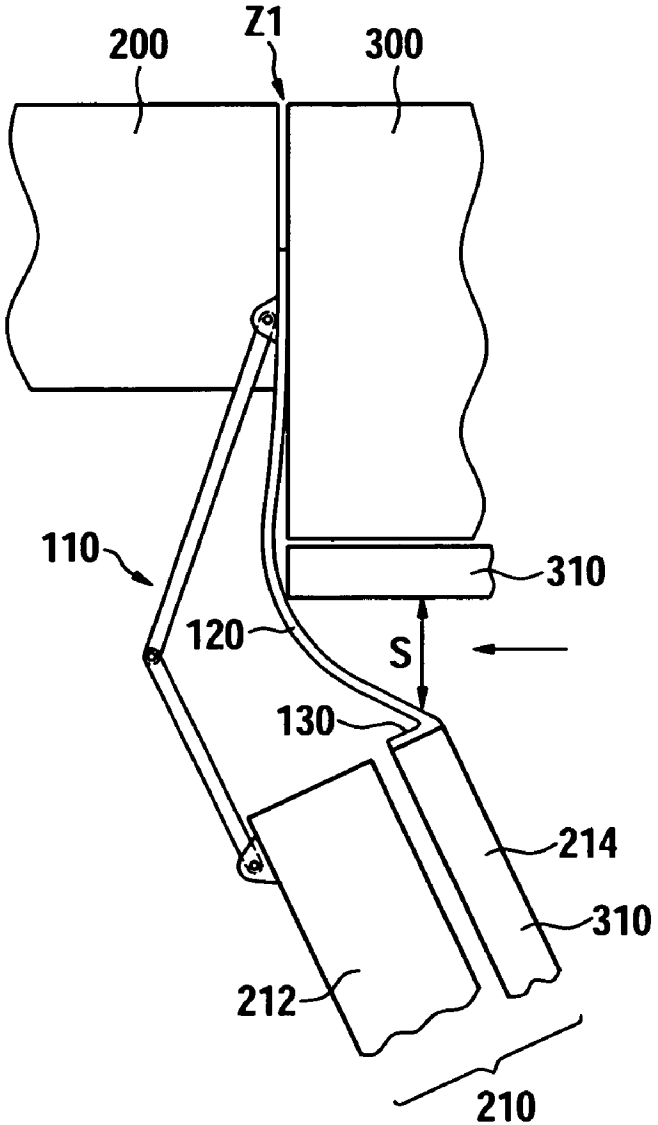

| | | | | | |
|---|---|---|---|---|---|
| 2,641,792 | A | * | 6/1953 | Peeler | 16/250 |
| 2,995,785 | A | * | 8/1961 | Hallenbeck | 49/383 |
| 3,628,845 | A | * | 12/1971 | Grimm | 312/309 |
| 3,827,105 | A | * | 8/1974 | Branchaud | 16/286 |
| 5,265,954 | A | | 11/1993 | Keil | |
| 2003/0051314 | A1 | | 3/2003 | Jenks | |
| 2005/0029080 | A1 | | 2/2005 | Rupp | |

FOREIGN PATENT DOCUMENTS

| | | |
|---|---|---|
| DE | 195 07 624 | 9/1996 |
| FR | 2 420 633 | 10/1979 |
| GB | 1 447 293 | 8/1976 |
| JP | 9-228733 | 9/1997 |

* cited by examiner

BUILT-IN DOMESTIC APPLIANCE WITH HINGE COVER

The invention relates to a built-in domestic appliance, especially a built-in refrigerator which comprises hinges for hinging a door to the furniture body of the built-in domestic appliance for closing an opening of the furniture body.

Built-in domestic appliances in the prior art are typically embodied so that the hinges used in such cases implement a predefined opening and closing movement for the door relative to the furniture body. With built-in domestic appliances for the US American market a gap is formed between an edge, especially a vertical edge, of the door of the first furniture body and the front of a second furniture body adjoining the first furniture body. This gap presents a significant potential danger for the user of the built-in domestic appliance, since their limbs can possibly get caught if they (inadvertently) intrude into the gap. In the USA in particular the potential danger is associated with the risk of significant claims for damages against the manufacturer of the built-in domestic appliance.

A solution is known from the prior art for a quite similar problem, namely the danger of injury and especially the danger of the limbs of a user of a built-in domestic appliance being inadvertently caught in a hinge, said solution being disclosed in application DE 44 18 238 A1. This application teaches that a cover be provided for a multilink hinge, which encapsulates the hinge during preferably all possible hinging movements to protect against any intrusion. The cover features an elastic plate element in the form of an elastic tongue, which extends between the door and the body of the built-in kitchen appliance, meaning typically in a vertical direction, but is restricted in its length to the height of the hinge.

The underlying object of the invention, using the prior art as its point of departure, is to use simple constructional measures to reduce a risk of injury, especially a risk of catching a limb which arises as a consequence of the inevitable gap between an edge of the first furniture body and for example the front of a second furniture body adjoining the first furniture body.

This object is achieved by the subject matter of the claims. This is characterized by a plate element being supported on the one hand in the area of the door and on the other hand in the transitional area between the first and the second furniture body so that it covers the gap, preferably over its entire length.

In particular an inadvertent intrusion of limbs of a user of the furniture body or of the built-in domestic appliance into the gap is effectively prevented by the claimed specific arrangement of the plate element. It concrete terms the danger of limbs becoming caught, as might otherwise arise through the opening and closing movement of the door relative to the furniture body, is prevented. This means that the invention not only significantly contributes to a reduction in the risk of injury to a user, but advantageously also contributes significantly to avoiding the risk of liability of the supplier or manufacturer of the furniture bodies or built-in domestic appliances.

The width of the gap can change during the predetermined opening and closing movement. The distance between the door and the first and/or second furniture body then also changes. In order to guarantee a reliable and most complete possible covering of the gap over its entire width, even if the width of the gap or of the described distance changes in this way, it is advantageous for the plate element to be mounted by one side in the area of the furniture bodies or to the door and by its other opposite side in the area of the door or in the area of the furniture bodies arranged to allow free movement.

Advantageously the freely movable side, also referred to as the free end of the plate element below, is guided and supported in a guide device.

In order not to impose too great a strain on the flexibility of the plate element, especially at extreme hinge positions of the door within the context of its opening or closing movement, it is advantageous for the plate element to be fixed or hinged to the door by a hinge element.

Finally it is advantageous for the plate element to be embodied as a multipart element, for example in the form of a number of interconnected leaves. On the one hand this type of embodiment is to be designed to be so stable as to safely prevent unintentional intrusion of limbs into the gap, and on the other hand to be so flexible as not to impede any possible opening or closing movement of the door.

Further advantageous embodiments of the hinge are object of the subclaims.

A total of 5 figures are enclosed with the description, with

Figure 1:
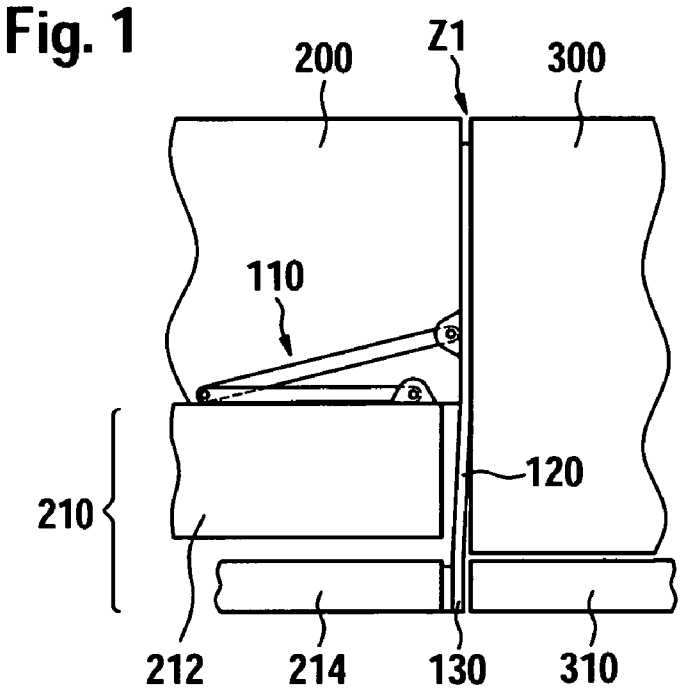
Figure 4:
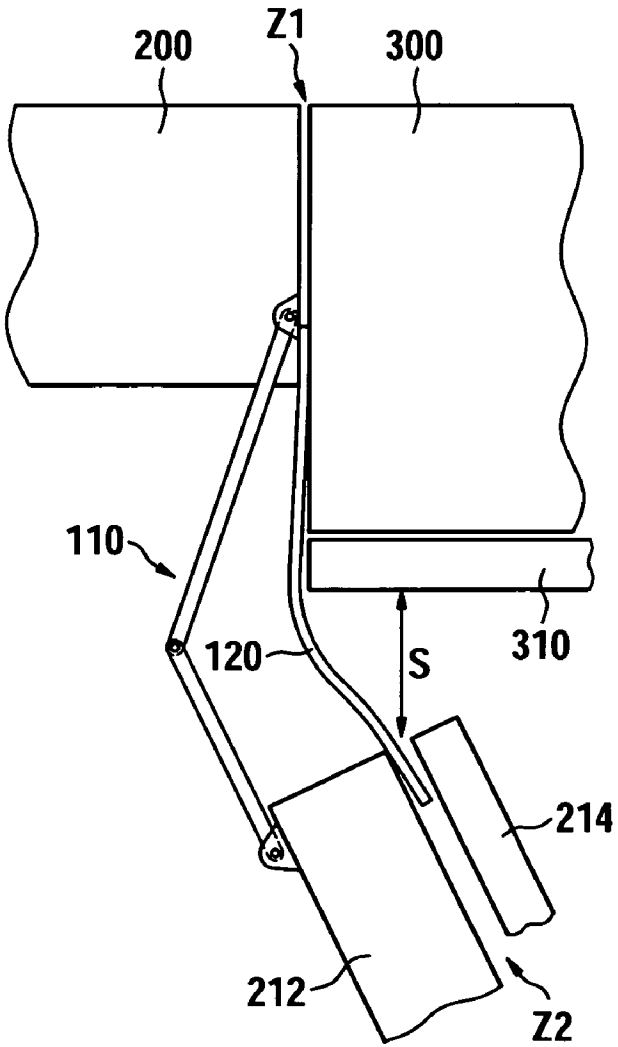
Figure 3:
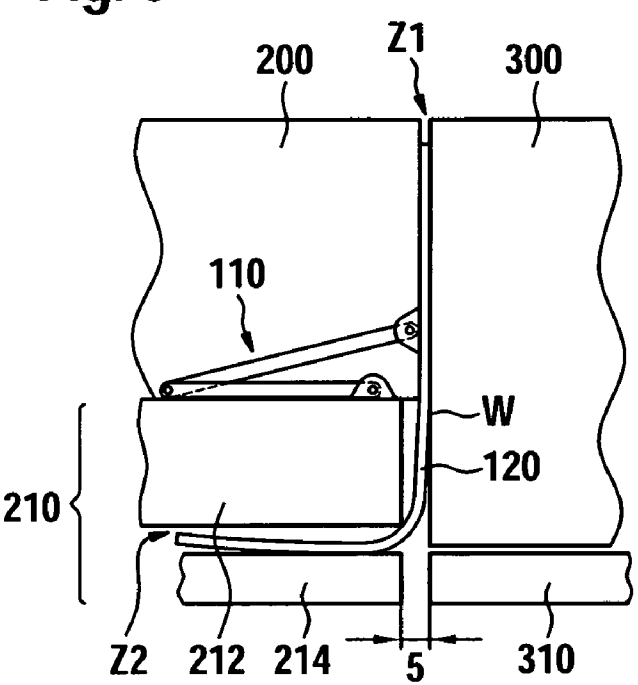
Figure 5:
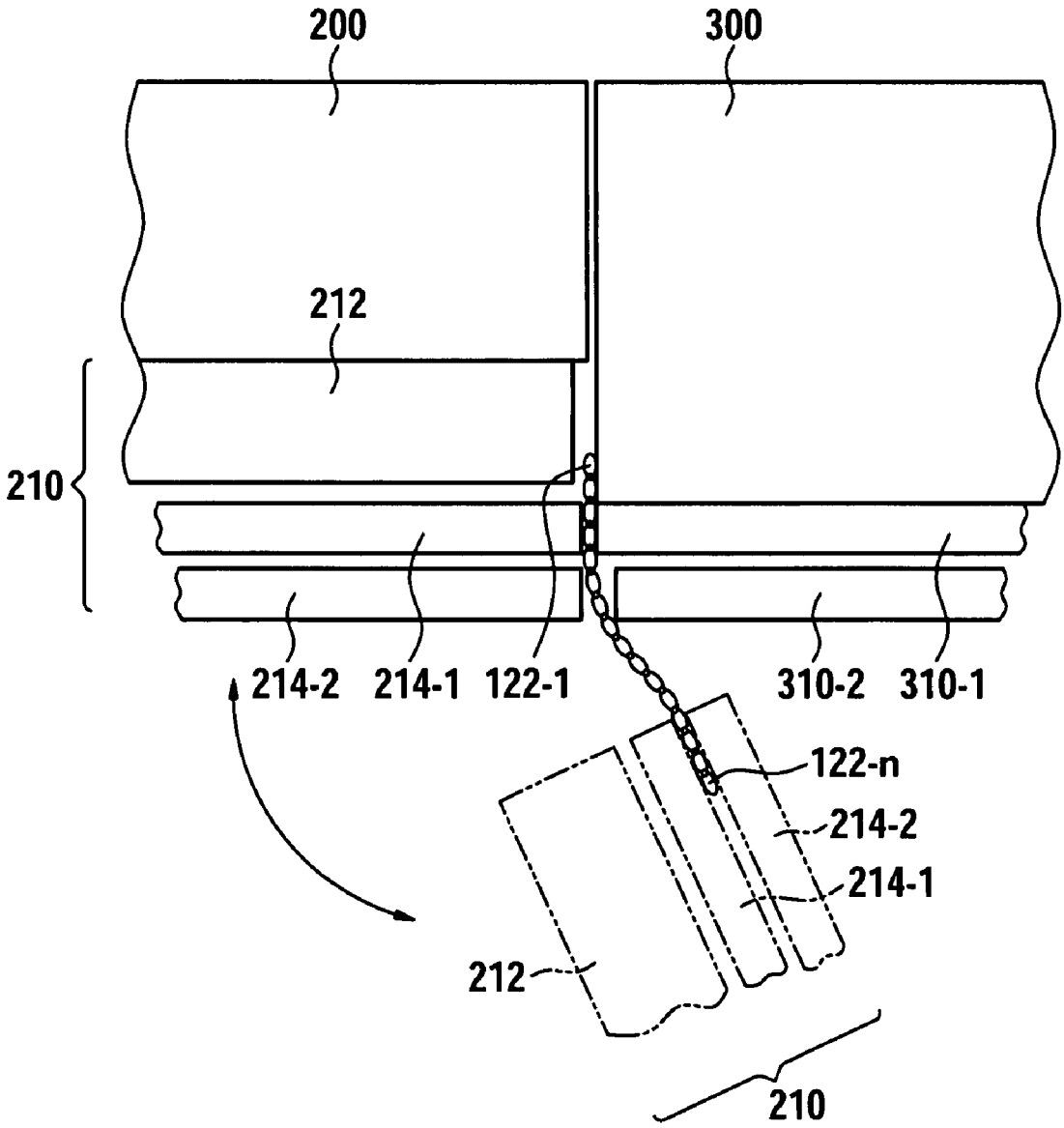

FIG. 1 showing an overhead view of two furniture bodies with the hinge in accordance with a first exemplary embodiment of the invention with the door closed;

FIG. 2 showing an overhead view of the adjoining furniture bodies with the first exemplary embodiment of the inventive hinge cover with the door open;

FIG. 3 showing a second exemplary embodiment of the inventive gap cover with the door closed;

FIG. 4 showing the second exemplary embodiment of the inventive gap cover with the door open; and FIG. 5 showing variants in the embodiment of the door and of a plate element.

The invention will be described below in detail on the basis of exemplary embodiments which refer to the said figures. Elements which are the same are shown by the same reference symbols in all the figures.

FIGS. 1 and 2 show a first exemplary embodiment of the inventive gap cover.

FIG. 1 shows an overhead view of two adjoining furniture bodies 200 and 300. The furniture bodies can for example be built-in domestic appliances for building into a fitted kitchen. In concrete terms the first furniture body 200 can for example be a refrigerator. An opening (not shown) of the first furniture body 200 is closed off by a door 210. The door 210 is hinged via hinges 110 on the first furniture body 200. The door 210 is shown in FIG. 1 in a position in which it closes the opening, i.e. in its closed state. The door 210 consists of an actual furniture body door 212 to close the opening and here for example of a front panel 214 supported in front of the body door. In FIG. 1 the second furniture body 300 adjoining the first furniture body 200 typically features a door 310, with the door 310 and the front panel 214 preferably being arranged so that they are flush with each other and therefore form one uniform smooth front.

Furthermore a flexible plate element 120 can be seen in FIG. 1 in cross-section. In accordance with FIG. 1 it is typically mounted on the edge of the front panel 214 facing towards the door 310 and is supported in a first space Z1 between the first and second furniture body 200, 300 to allow free movement.

FIG. 2 shows the arrangement already known from FIG. 1 of the two adjoining furniture bodies 200 and 300, but here with an opened door 210 however. In the indicated hinged position of the door 210 a gap S between the door 310 of the second furniture body and an edge of the door 210 facing this door 310 can be seen. The width of this gap depends on the relevant hinged position of the door 210 relative to the furniture bodies. It presents a considerable risk of injury, especially a risk to the limbs of a user of the furniture body being caught, if these, coming for example from the direction of the arrow, intrude into the gap and the door 210 is moved in a closing direction.

The object of the plate element 120 is to prevent this type of intrusion. To this end it is embodied to be sufficiently stable and to not be too pliable. In concrete terms it is embodied on the one hand to resist an attempt to insert a limb into the gap and to restrict the depth of this intrusion to a minimum. On the other hand the plate element 120 must be embodied so flexibly that it moves as smoothly as possible to follow the hinging movement of the door 210. In order not to impose too great a strain on the required flexibility, it is advantageous for the plate element 120 to be mounted via a hinge unit 130, preferably a film hinge, to the door 210. In FIG. 2 the hinge element 130 is mounted on the edge of the front panel 214 facing towards the second furniture body. As an alternative to this, the hinge element 130 can also be mounted on the corresponding edge of the furniture body door 212 or to another point on the front panel 214 or the furniture body door 212.

FIGS. 3 and 4 show a second exemplary embodiment of the inventive hinge.

FIG. 3 essentially shows the arrangement already known from FIG. 1 of the two adjoining furniture bodies 200 and 300. Unlike in FIG. 1 the plate element 120 is shown here however in accordance with the second exemplary embodiment. Accordingly the plate element 120 is not arranged on the door 210, but in a transitional area between the first and second furniture body 200, 300. In concrete terms the plate element 120 is mounted here in the first space Z1, on the first furniture body 200 for example. As an alternative to this it could also be mounted on any point on the wall W of the second furniture body 300 or to its front panel 310. Furthermore FIG. 3 shows that the free end of the plate element 120 lying opposite the mounted end is arranged to allow free movement in a space Z2 between the furniture body door 212 and the front panel 214 of the first furniture body 200, preferably guided in a guide rail (not shown here).

FIG. 4 shows the plate element 120 with the door 210 opened. It can be seen that the plate element, because of its elasticity, follows the hinge movement of the door. Because of this hinge movement the gap S between the door 210 and the front panel 310 has increased, which also means that the distance between the door 210 and the first furniture body has become wider. Because of the increase in this distance the plate element 210 in the hinge position shown in FIG. 4 has been withdrawn further from the second space Z2 compared to its position shown in FIG. 3. It is important however for it not to be withdrawn completely, but for a part of the plate element 120 to still remain in the space Z2 and to be held there in order to be able to resist any intrusion into the gap.

FIG. 5 once more illustrates the known arrangement of the adjoining furniture bodies 200 and 300. The door 210 is illustrated in this diagram both in the closed and also in the opened hinged position. The front panel 214 is a multilayer panel here, constructed from two front elements 214-1 and 214-2 for example. In the same way the front panel 310 of the second furniture body 300 is constructed from two front elements 310-1 and 310-2. This layout of the front panels is especially typical of US American fitted kitchens.

With this type of multilayer construction of the front panel 214 the plate element 120 can also be mounted in accordance with the first exemplary embodiment of invention on one front element 214-1, 214-2 or on both front elements. As an alternative to this, the front element 120 in accordance with the second exemplary embodiment of the invention is arranged to allow free movement in a third space between the two front elements 214-1 and 214-2, preferably guided.

Regardless of the exemplary embodiment selected, the flexibility of the plate element 120 can also be implemented or supported by the plate element 120 being formed from multiple sections, preferably in the form of a plurality of leaves 122-1 . . . -n connected to each other in an articulated arrangement.

The plate element preferably extends over the entire length of the gap S (perpendicular to the plane of the diagram), i.e. if necessary over the entire height of the first furniture body or the height of its door 210.

The invention claimed is:

1. A built-in domestic appliance comprising:

a furniture body of the appliance;

a door;

hinges mounting the door to the furniture body of the appliance for closing an opening of the furniture body of the appliance, the hinges being embodied to implement an opening and closing movement of the door; and a flexible plate element being supported on one end in the area of the door and on a second end on a side of the furniture body of the appliance such that the second end is adapted to be in a transitional area between the furniture body of the appliance and a second furniture body adjacent to the furniture body of the appliance so that the flexible plate element is adapted to cover a gap between an edge of the door and a front of the second furniture body when the door is open, the flexible plate element being adapted to cover the gap over an entire length of the gap in a direction substantially parallel to a pivot axis of one of the hinges.

2. The built-in domestic appliance as claimed in claim 1, wherein the door includes an actual furniture body door to close off the opening and a front panel comprising at least one layer positioned in front of the furniture body door.

3. The built-in domestic appliance as claimed in claim 2, wherein the flexible plate element is mounted on at least one of the furniture body door and one of the layers of the front panel.

4. The built-in domestic appliance as claimed in claim 3, wherein the flexible plate element is supported for indirect mounting via a hinge element on at least one of the furniture body door and one of the layers of the front panel.

5. The built-in domestic appliance as claimed in claim 2, wherein the flexible plate element is adapted to be positioned in a space between the furniture body of the appliance and the second furniture body to allow free movement.

6. The built-in domestic appliance as claimed in claim 2, wherein the flexible plate element is adapted to be mounted in the transitional area on at least one of the first and second furniture bodies.

7. The built-in domestic appliance as claimed in claim 6, wherein the flexible plate element is supported to allow free movement in a space between the furniture body door and front panel supported in front of the furniture body door.

8. The built-in domestic appliance as claimed in claim 6, wherein the flexible plate element is supported to allow free movement in a space between two layers of the front panel.

9. The built-in domestic appliance as claimed in claim 1, wherein the flexible plate element includes a multi-section plate in the form of a number of interconnected leaves.

10. The built-in domestic appliance as claimed in claim 1, wherein the flexible plate element is substantially stable to resist an intrusion into the gap and is substantially flexible to impede the opening and closing movement of the door as little as possible.

11. The built-in domestic appliance as claimed in claim 1, wherein the built-in domestic appliance includes a built-in refrigerator.

12. A built-in appliance, comprising:

a body of the appliance for positioning adjacent to an adjacent body;

a door covering an opening in the body of the appliance;

a hinge attaching the door to the body of the appliance such that the door can be pivoted between an open position where the opening is open, and a closed position where the opening is closed, the hinge having a pivot axis; and a flexible plate element having a first edge positioned at the door, and a second edge for positioning between the body of the appliance and the adjacent body, wherein the flexible plate element is adapted to cover substantially all of a gap between the door and the adjacent body when the door is in the open position.

13. The built-in appliance as claimed in claim 12, wherein the door includes a body door to close off the opening and a front panel positioned on a side of the body door opposite the body of the appliance.

14. The built-in appliance as claimed in claim 13, wherein the flexible plate element is fixed to at least one of the body door and the front panel.

15. The built-in appliance as claimed in claim 14, wherein the flexible plate element has a hinge element at one of its first edge and its second edge.

16. The built-in appliance as claimed in claim 13, wherein the second edge of the flexible plate element is adapted to be slidably positioned in a space between the body of the appliance and the adjacent body.

17. The built-in appliance as claimed in claim 13, wherein the second edge of the flexible plate element is fixed to the body of the appliance.

18. The built-in appliance as claimed in claim 13, wherein the second end is adapted to be fixed to the adjacent body.

19. The built-in appliance as claimed in claim 17, wherein the first edge of the flexible plate element is slidably positioned in a space between the body door and the front panel.

20. The built-in appliance as claimed in claim 17, wherein the front panel has two layers and the flexible plate element is slidably positioned in a space between the two layers of the front panel.

21. The built-in appliance as claimed in claim 12, wherein the flexible plate element includes a multi-section plate in the form of a number of interconnected leaves.

22. The built-in appliance as claimed in claim 12, wherein the flexible plate element does not impede the opening and closing movement of the door.

23. The built-in appliance as claimed in claim 12, wherein the built-in appliance includes a built-in refrigerator.

24. The built-in domestic appliance as claimed in claim 1, further comprising the second furniture body, wherein, the second furniture body is adjacent to the furniture body of the appliance, the second end of the flexible plate element is located in the transitional area between the furniture body of the appliance and the second furniture body so that the flexible plate element covers the gap between the edge of the door and the front of the second furniture body when the door is open, and the flexible plate element covers the gap over the entire length of the gap in the direction substantially parallel to the pivot axis of one of the hinges.

25. The built-in appliance as claimed in claim 12, further comprising the adjacent body, wherein, the adjacent body is adjacent to the body of the appliance, the second edge of the flexible plate element is positioned between the body of the appliance and the adjacent body, and the flexible plate element covers substantially all of the gap between the door and the adjacent body when the door is in the open position.

* * * * *